US011776453B2

(12) United States Patent
Cao

(10) Patent No.: US 11,776,453 B2
(45) Date of Patent: Oct. 3, 2023

(54) DISPLAY SUBSTRATE INCLUDING PIXEL CIRCUIT RECEIVING INITIAL VOLTAGE AND FIRST POWER SUPPLY VOLTAGE TO TURN ON DRIVING MODULE AND DRIVING METHOD THEREOF, AND DISPLAY APPARATUS

(71) Applicants: Chengdu BOE Optoelectronics Technology Co., Ltd., Sichuan (CN); BOE Technology Group Co., Ltd., Beijing (CN)

(72) Inventor: Xilei Cao, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/231,019

(22) Filed: Apr. 15, 2021

(65) Prior Publication Data

US 2022/0114943 A1 Apr. 14, 2022

(30) Foreign Application Priority Data

Oct. 10, 2020 (CN) ..... 202011080088.4

(51) Int. Cl.
*G09G 3/20* (2006.01)
*G09G 3/3291* (2016.01)
*G09G 3/3258* (2016.01)

(52) U.S. Cl.
CPC ..... *G09G 3/2092* (2013.01); *G09G 3/3258* (2013.01); *G09G 3/3291* (2013.01); *G09G 2310/061* (2013.01)

(58) Field of Classification Search
None
See application file for complete search history.

(56) References Cited

U.S. PATENT DOCUMENTS

2007/0236424 A1* 10/2007 Kimura ..... H01L 27/3276 345/76
2012/0147060 A1* 6/2012 Jeong ..... G09G 3/3233 345/82

(Continued)

FOREIGN PATENT DOCUMENTS

CN 102568374 A 7/2012
CN 105206220 A 12/2015

(Continued)

OTHER PUBLICATIONS

Office Action dated Apr. 28, 2021 for Chinese Patent Application No. 202011080088.4 and English Translation.

*Primary Examiner* — Kirk W Hermann
(74) *Attorney, Agent, or Firm* — Ling Wu; Stephen Yang; Ling and Yang Intellectual Property

(57) ABSTRACT

A pixel circuit includes a light-emitting element, a voltage providing module, a voltage writing-in module and a driving module. The voltage providing module is respectively connected with a first power supply voltage terminal, an initial voltage terminal, a reset signal terminal, a light-emitting control terminal, a voltage writing-in module and a driving module, and is configured to provide a voltage of the first power supply voltage terminal and a voltage of the initial voltage terminal to the driving module under control of the reset signal terminal to turn on the driving module; and provide the voltage of the first power supply voltage terminal to the driving module under control of the light-emitting control terminal.

13 Claims, 6 Drawing Sheets

(56) References Cited

U.S. PATENT DOCUMENTS

| | | | | |
|---|---|---|---|---|
| 2016/0187695 | A1* | 6/2016 | Cho | H01L 27/124 349/12 |
| 2016/0284269 | A1 | 9/2016 | Sun et al. | |
| 2017/0047003 | A1* | 2/2017 | Kim | G09G 3/3233 |
| 2017/0270866 | A1* | 9/2017 | Asano | G09G 3/3233 |
| 2018/0076273 | A1* | 3/2018 | Kim | H01L 27/3265 |
| 2019/0164491 | A1* | 5/2019 | Kim | H10K 59/131 |
| 2020/0005708 | A1* | 1/2020 | Hwang | H01L 27/3276 |
| 2020/0243013 | A1 | 7/2020 | Wang et al. | |
| 2021/0074213 | A1 | 3/2021 | Huang et al. | |
| 2021/0090494 | A1* | 3/2021 | Hwang | G09G 3/3291 |

FOREIGN PATENT DOCUMENTS

| | | | | | |
|---|---|---|---|---|---|
| CN | 107316613 | A | | 11/2017 | |
| CN | 107610651 | A | * | 1/2018 | |
| CN | 107610651 | A | | 1/2018 | |
| CN | 109256094 | A | * | 1/2019 | G09G 3/3258 |
| CN | 109256094 | A | | 1/2019 | |
| CN | 110299385 | A | | 10/2019 | |
| CN | 111261110 | A | | 6/2020 | |
| CN | 111462694 | A | | 7/2020 | |

* cited by examiner

DISPLAY SUBSTRATE INCLUDING PIXEL CIRCUIT RECEIVING INITIAL VOLTAGE AND FIRST POWER SUPPLY VOLTAGE TO TURN ON DRIVING MODULE AND DRIVING METHOD THEREOF, AND DISPLAY APPARATUS

CROSS-REFERENCE TO RELATED APPLICATION

The present application claims the priority of Chinese Patent Application No. 202011080088.4 filed to the CNIPA on Oct. 10, 2020, the content of which is hereby incorporated by reference.

TECHNICAL FIELD

Embodiments of the present disclosure relate to, but are not limited to, the technical field of display, in particular to a pixel circuit and a driving method thereof, a display substrate and a display apparatus.

BACKGROUND

Organic Light Emitting Diode (OLED) display panels have gradually occupied the vast majority of the market in recent years. The OLED display panels have attracted wide attention of people with its thin and light, excellent display effect, high contrast, wide color gamut, flexibility, or the like, and the OLED display panel is considered as a next generation display solution that is expected to replace liquid crystal.

With the increasing demands for screen display diversification, improving screen utilization has become a new development demand. At present, power consumption is generally reduced by reducing a refresh frequency of a screen to meet demands under some displays.

SUMMARY

The following is a summary of the subject matter described in detail in the present disclosure. This summary is not intended to limit the protection scope of the claims. Embodiments of the present disclosure mainly provide following technical solutions.

A pixel circuit is provided, including: a light-emitting element, a voltage providing module, a voltage writing-in module and a driving module.

The voltage providing module is respectively connected with a first power supply voltage terminal, an initial voltage terminal, a reset signal terminal, a light-emitting control terminal, the voltage writing-in module and the driving module, and the voltage providing module is configured to provide a voltage of the first power supply voltage terminal and a voltage of the initial voltage terminal to the driving module under control of the reset signal terminal to turn on the driving module; and provide the voltage of the first power supply voltage terminal to the driving module under control of the light-emitting control terminal.

The voltage writing-in module is respectively connected with a signal terminal, a data input terminal, the initial voltage terminal, the voltage providing module, the driving module and the light-emitting element, and the voltage writing-in module is configured to write a data voltage into the driving module under control of the signal terminal.

The driving module is respectively connected with the voltage providing module and the voltage writing-in module, and the driving module is configured to provide a driving current to the light-emitting element.

In an exemplary implementation, the voltage providing module includes a reset module and a voltage supply module.

The reset module is respectively connected with the reset signal terminal, the initial voltage terminal, the voltage writing-in module and the driving module, and the reset module is configured to provide the voltage of the initial voltage terminal to the driving module under the control of the reset signal terminal.

The voltage supply module is respectively connected with the reset signal terminal, the light-emitting control terminal, the first power supply voltage terminal, the voltage writing-in module and the driving module, and the voltage supply module is configured to provide the voltage of the first power supply voltage terminal to the driving module under the control of the reset signal terminal; and provide the voltage of the first power supply voltage terminal to the driving module under the control of the light-emitting control terminal.

In an exemplary implementation, the reset module includes a first transistor. A control terminal of the first transistor is connected with the reset signal terminal, a first terminal of the first transistor is respectively connected with the initial voltage terminal and the voltage writing-in module, and a second terminal of the first transistor is respectively connected with the voltage writing-in module and the driving module.

In an exemplary implementation, the voltage supply module includes a second transistor and a third transistor. A control terminal of the second transistor is connected with the reset signal terminal, a first terminal of the second transistor is connected with the first power supply voltage terminal, and a second terminal of the second transistor is respectively connected with the voltage writing-in module and the driving module. A control terminal of the third transistor is connected with the light-emitting control terminal, a first terminal of the third transistor is connected with the first terminal of the second transistor, and a second terminal of the third transistor is connected with the second terminal of the second transistor.

In an exemplary implementation, the driving module includes a fourth transistor. A control terminal of the fourth transistor is respectively connected with the reset module and the voltage writing-in module, a first terminal of the fourth transistor is respectively connected with the voltage supply module and the voltage writing-in module, and a second terminal of the fourth transistor is connected with the voltage writing-in module.

In an exemplary implementation, the driving module includes a fifth transistor and a sixth transistor. A control terminal of the fifth transistor is respectively connected with the reset module and the voltage writing-in module, a first terminal of the fifth transistor is respectively connected with the voltage supply module and the voltage writing-in module, and a second terminal of the fifth transistor is connected with the voltage writing-in module. A control terminal of the sixth transistor is connected with a preset potential, a first terminal of the sixth transistor is connected with the first terminal of the fifth transistor, and a second terminal of the sixth transistor is connected with the second terminal of the fifth transistor.

In an exemplary implementation, the voltage writing-in module includes a seventh transistor, an eighth transistor and a ninth transistor. A control terminal of the seventh transistor is connected with the signal terminal, a first terminal of the seventh transistor is respectively connected with the voltage supply module and the driving module, and a second terminal of the seventh transistor is connected with the data input terminal. A control terminal of the eighth transistor is connected with the signal terminal, a first terminal of the eighth transistor is respectively connected with the reset module and the driving module, and a second terminal of the eighth transistor is connected with the driving module. A control terminal of the ninth transistor is connected with the signal terminal, a first terminal of the ninth transistor is respectively connected with the reset module and the initial voltage terminal, and a second terminal of the ninth transistor is connected with the light-emitting element.

In an exemplary implementation, the pixel circuit includes a light-emitting control module; wherein, the light-emitting control module is respectively connected with the light-emitting control terminal, the voltage writing-in module, the driving module and the light-emitting element, and the light-emitting control module is configured to control the light-emitting element to emit light under the control of the light-emitting control terminal; and the light-emitting element is connected with a second power supply voltage terminal.

In an exemplary implementation, the light-emitting control module includes a tenth transistor, wherein a control terminal of the tenth transistor is connected with the light-emitting control terminal, a first terminal of the tenth transistor is respectively connected with the voltage writing-in module and the light-emitting element, and a second terminal of the tenth transistor is respectively connected with the voltage writing-in module and the driving module.

In an exemplary implementation, the pixel circuit includes a voltage holding module; wherein, the voltage holding module is respectively connected with the first power supply voltage terminal, the control terminal of the fourth transistor, the voltage writing-in module and the reset module, and the voltage holding module is configured to hold a voltage of the control terminal of the fourth transistor.

In an exemplary implementation, the voltage holding module includes a capacitor; wherein one terminal of the capacitor is connected with the first power supply voltage terminal, and the other terminal of the capacitor is respectively connected with the control terminal of the fourth transistor, the voltage writing-in module and the reset module.

A display substrate is provided, including multiple pixel units disposed in an array, wherein each of the multiple pixel units includes a pixel circuit, the pixel circuit includes a light-emitting element, a voltage providing module, a voltage writing-in module and a driving module.

The voltage providing module is respectively connected with a first power supply voltage terminal, an initial voltage terminal, a reset signal terminal, a light-emitting control terminal, the voltage writing-in module and the driving module, and the voltage providing module is configured to provide a voltage of the first power supply voltage terminal and a voltage of the initial voltage terminal to the driving module under control of the reset signal terminal to turn on the driving module; and provide the voltage of the first power supply voltage terminal to the driving module under control of the light-emitting control terminal.

The voltage writing-in module is respectively connected with a signal terminal, a data input terminal, the initial voltage terminal, the voltage providing module, the driving module and the light-emitting element, and the voltage writing-in module is configured to write a data voltage into the driving module under control of the signal terminal.

The driving module is respectively connected with the voltage providing module and the voltage writing-in module, and the driving module is configured to provide a driving current to the light-emitting element.

In an exemplary implementation, the voltage providing module includes a reset module and a voltage supply module. The reset module is respectively connected with the reset signal terminal, the initial voltage terminal, the voltage writing-in module and the driving module, and the reset module is configured to provide the voltage of the initial voltage terminal to the driving module under the control of the reset signal terminal. The voltage supply module is respectively connected with the reset signal terminal, the light-emitting control terminal, the first power supply voltage terminal, the voltage writing-in module and the driving module, and the voltage supply module is configured to provide the voltage of the first power supply voltage terminal to the driving module under the control of the reset signal terminal; and provide the voltage of the first power supply voltage terminal to the driving module under the control of the light-emitting control terminal.

In an exemplary implementation, the reset module includes a first transistor; wherein, a control terminal of the first transistor is connected with the reset signal terminal, a first terminal of the first transistor is respectively connected with the initial voltage terminal and the voltage writing-in module, and a second terminal of the first transistor is respectively connected with the voltage writing-in module and the driving module.

In an exemplary implementation, the voltage supply module includes a second transistor and a third transistor. A control terminal of the second transistor is connected with the reset signal terminal, a first terminal of the second transistor is connected with the first power supply voltage terminal, and a second terminal of the second transistor is respectively connected with the voltage writing-in module and the driving module. A control terminal of the third transistor is connected with the light-emitting control terminal, a first terminal of the third transistor is connected with the first terminal of the second transistor, and a second terminal of the third transistor is connected with the second terminal of the second transistor.

In an exemplary implementation, the driving module includes a fourth transistor; wherein, a control terminal of the fourth transistor is respectively connected with the reset module and the voltage writing-in module, a first terminal of the fourth transistor is respectively connected with the voltage supply module and the voltage writing-in module, and a second terminal of the fourth transistor is connected with the voltage writing-in module.

In an exemplary implementation, the driving module includes a fifth transistor and a sixth transistor. A control terminal of the fifth transistor is respectively connected with the reset module and the voltage writing-in module, a first terminal of the fifth transistor is respectively connected with the voltage supply module and the voltage writing-in module, and a second terminal of the fifth transistor is connected with the voltage writing-in module. A control terminal of the sixth transistor is connected with a preset potential, a first terminal of the sixth transistor is connected with the first terminal of the fifth transistor, and a second terminal of the sixth transistor is connected with the second terminal of the fifth transistor.

In an exemplary implementation, the voltage writing-in module includes a seventh transistor, an eighth transistor and a ninth transistor. A control terminal of the seventh transistor is connected with the signal terminal, a first terminal of the seventh transistor is respectively connected with the voltage supply module and the driving module, and a second terminal of the seventh transistor is connected with the data input terminal. A control terminal of the eighth transistor is connected with the signal terminal, a first terminal of the eighth transistor is respectively connected with the reset module and the driving module, and a second terminal of the eighth transistor is connected with the driving module. A control terminal of the ninth transistor is connected with the signal terminal, a first terminal of the ninth transistor is respectively connected with the reset module and the initial voltage terminal, and a second terminal of the ninth transistor is connected with the light-emitting element.

A display apparatus is provided, including any of the above display substrates.

A driving method of a pixel circuit is provided, including: under control of a reset signal terminal, receiving a voltage output by an initial voltage terminal and a voltage output by a first power supply voltage terminal to turn on a driving module; under control of a signal terminal, initializing an anode of a light-emitting element, and receiving a data voltage output by a data input terminal, and writing the data voltage into the driving module; and under control of a light-emitting control terminal, receiving the voltage of the first power supply voltage terminal and inputting the voltage to the driving module, providing, by the driving module, a driving current to the light-emitting element.

The above description is only a summary of technical solutions of embodiments of the present disclosure. In order to understand more clearly technical means of the embodiments of the present disclosure, and to implement them according to contents of the specification, and in order to make the above and other objects, features and advantages of the embodiments of the present disclosure more obvious and understandable, specific implementations of the embodiments of the present disclosure are particularly given below.

Other aspects will become apparent upon reading and understanding accompanying drawings and the detailed description.

BRIEF DESCRIPTION OF DRAWINGS

Various other advantages and benefits will become apparent to those having ordinary skill in the art after they read the following detailed description of alternative embodiments. The drawings are only for the purpose of illustrating alternative embodiments, and are not to be considered as limitations to embodiments of the present disclosure. Furthermore, throughout the drawings, same elements are denoted by same reference symbols.

DETAILED DESCRIPTION

Figure 1:
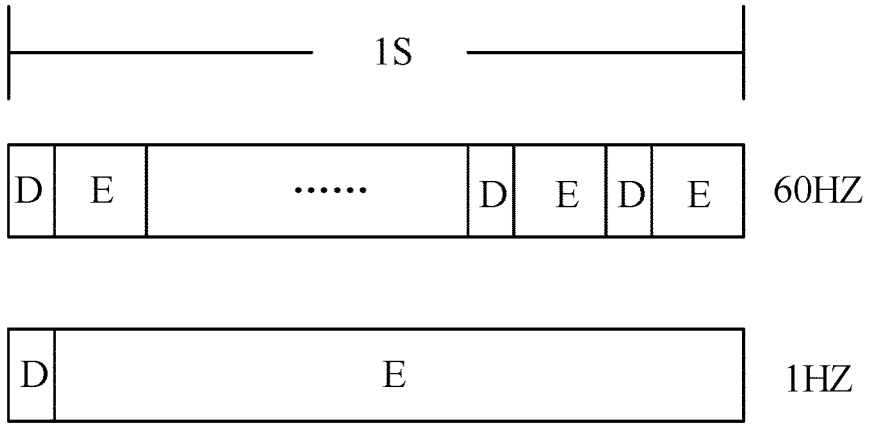
FIG. 1 is a schematic diagram of a mode of a pixel circuit working at a low frequency.

Exemplary implementations of the present disclosure will be described in more detail below with reference to accompanying drawings. Although exemplary implementations of the present disclosure are shown in the drawings, it should be understood that the present disclosure may be implemented in various forms and should not be limited by the embodiments set forth herein. On the contrary, these embodiments are provided for a more thorough understanding of the present disclosure and for fully conveying the scope of the present disclosure to those skilled in the art. Without a conflict, these exemplary implementations may be arbitrarily combined with each other.

It can be understood by those skilled in the art, the singular forms "a", "an", "said" and "the" used herein may also include plural forms unless expressly stated. It should be further understood that the phase "including" used in the specification of the present disclosure means the presence of stated features, integers, acts, operations, elements and/or components, but does not exclude the presence or addition of one or more other features, integers, acts, operations, elements, components and/or groups thereof. It should be understood that, the phrase "and/or" as used herein includes all or any unit of one or more associated items listed and all combinations thereof.

It can be understood by those skilled in the art that unless otherwise defined, all terms (including technical terms and scientific terms) used herein have the same meanings as those generally understood by those skilled in the art to which the present disclosure pertains. It should also be understood that terms such as those defined in a general dictionary should be construed to have meanings consistent with those in the context of the current art, and will not be interpreted as idealized or overly formal meanings unless specifically defined.

At present, when a driving mode of a pixel circuit is switched to a low frequency, the number of data writings is reduced and corresponding data holding time is increased. Therefore, for characteristics of a thin film transistor, since the thin film transistor is in a certain state for a long time, a threshold voltage of the thin film transistor may drift, resulting in a brightness difference between a writing-in frame and a holding frame, and causing a brightness difference perceptible by human eyes.

FIG. 1 shows a mode of a pixel circuit working at a low frequency. As shown in FIG. 1, a refresh frequency of a pixel circuit under conventional driving is 60 HZ, and there are 60 frames per second, and 60 pieces of data are written into compensation periods Ds and light-emitting periods Es in one second. The refresh frequency is reduced at a low frequency, and taking 1 HZ as an example, one frame is refreshed in one second (one frame has only one D and one E).

Figure 2:
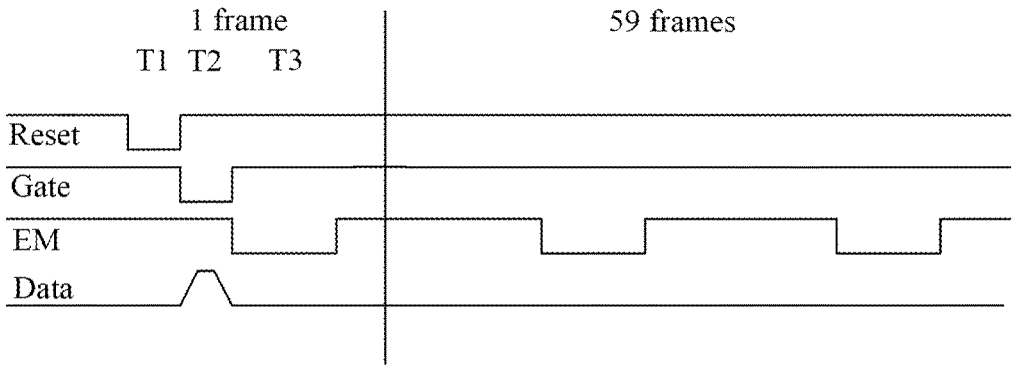
FIG. 2 is a schematic diagram of timing of a pixel circuit.

In an exemplary implementation, as shown in FIG. 2, in a first frame, data is normally written in, and in remaining 59 frames, data is not written in, and the data written in the first frame is used to make the OLED continue to emit light. Under this driving mode, a frame of image needs to be kept for a longer time, but if the same image is kept for a long time, a threshold voltage will drift and thereby affect characteristics of the thin film transistor, such that brightness of holding frames will be reduced, which will cause brightness decay that may be perceptible by human eyes.

Figure 3:
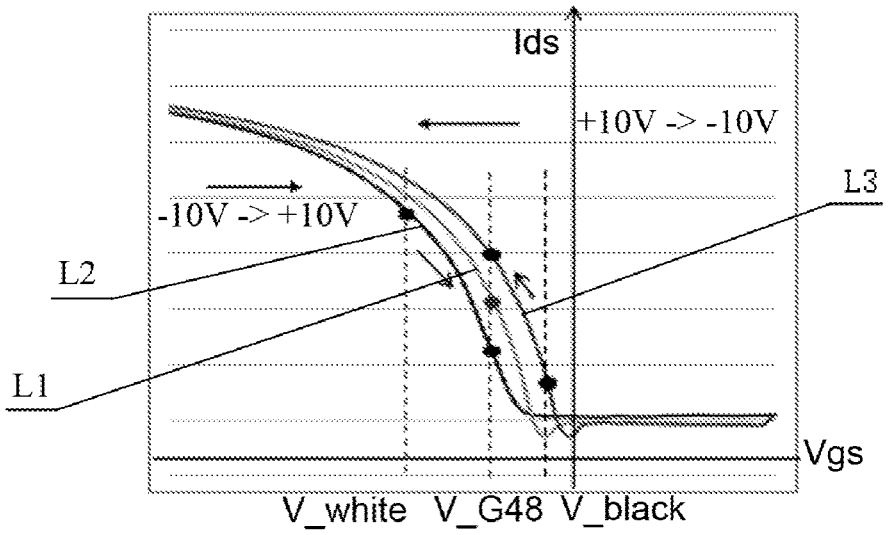
FIG. 3 is a graph of characteristic drift curves of a thin film transistor applied a specific voltage for a long time.

FIG. 3 shows characteristic drift curves of a thin film transistor to which a specific voltage is applied for a long time. Herein, a curve L1 is a normal 48 gray scale curve, a curve L2 is a white 255 gray scale curve, and a curve L3 is a 0 gray scale curve. When a display image is in the white 255 gray scale (that is, a high gray scale) for a long time, a point potential of a gate of a driving transistor is too low, an absolute value of Vgs is too large, and a negative bias of the driving transistor is large. When the high gray scale is switched to a low gray scale, a more gray scale will be caused. In an exemplary implementation, when a 255 gray scale is changed to a 48 gray scale, G48 should be on the curve L1, but due to hysteresis, a characteristic curve is still on the curve L2, resulting in that a current becomes smaller and brightness is degraded. If hysteresis influence is large, when an image is switched at a low frequency, it is easy to cause a brightness difference between a writing-in frame and a holding frame. If the difference is so large that human eyes can perceive it, there will be a phenomenon of flicker. In addition, when the image is in a low gray scale, a negative bias of VTH is relatively small, and when the image is switched to a high gray scale, brightness is relatively large. When a display panel is at a low frequency, the image stays in a same state for a long time, and the negative bias gradually increases. When the brightness is held, brightness decay will be caused between different frames, which will cause flicker. Particularly it is more obvious when a low gray scale is switched to a high gray scale.

An embodiment of the present disclosure provides a new pixel circuit, which may avoid flicker caused by brightness decay perceptible by human eyes when an image stays in a same state for a long time as the situation of the low frequency described above.

The pixel circuit provided by an embodiment of the present disclosure will be described in detail with reference to the accompanying drawings.

Figure 4:
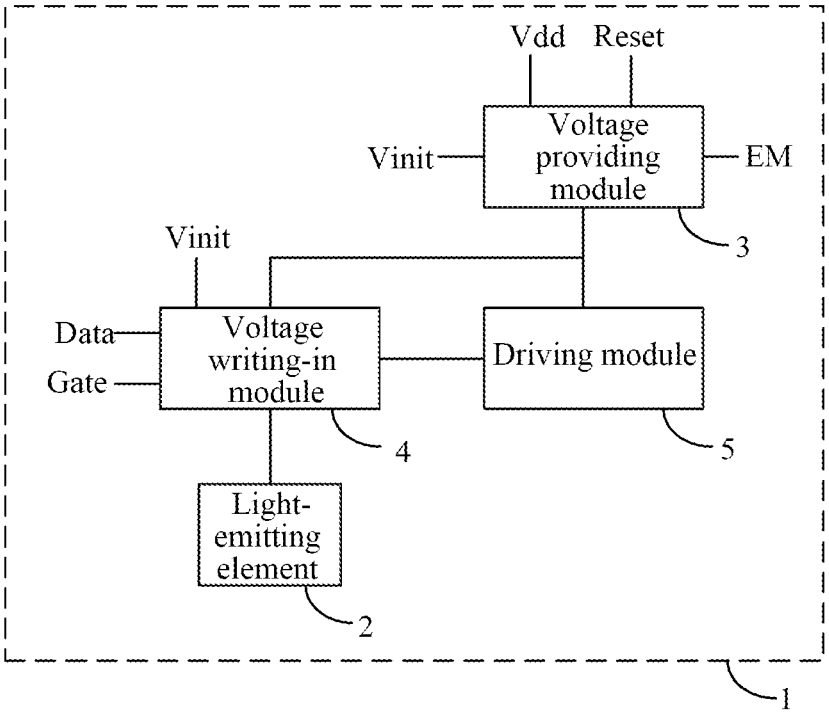
FIG. 4 is a block diagram of a structure of a pixel circuit according to an embodiment of the present disclosure.

FIG. 4 shows a pixel circuit 1 according to an embodiment of the present disclosure. As shown in FIG. 4, the pixel circuit 1 includes: a light-emitting element 2, a voltage providing module 3, a voltage writing-in module 4 and a driving module 5. The voltage providing module 3 is respectively connected with a first power supply voltage terminal Vdd, an initial voltage terminal Vinit, a reset signal terminal Reset, a light-emitting control terminal EM, a voltage writing-in module 4 and a driving module 5, and is configured to provide a voltage of the first power supply voltage terminal Vdd and a voltage of the initial voltage terminal Vinit to the driving module 5 under control of the reset signal terminal Reset to turn on the driving module 5; and provide the voltage of the first power supply voltage terminal Vdd to the driving module 5 under control of the light-emitting control terminal EM. The voltage writing-in module 4 is respectively connected with a signal terminal Gate, a data input terminal Data, the initial voltage terminal Vinit, the voltage providing module 3, the driving module 5 and the light-emitting element 2, and is configured to write a data voltage into the driving module 5 under control of the signal terminal Gate. The driving module 5 is respectively connected with the voltage providing module 3 and the voltage writing-in module 4, and is configured to provide a driving current to the light-emitting element 2.

In an exemplary implementation, the voltage providing module 3, the voltage writing-in module 4 and the driving module 5 are hardware circuit modules.

In the embodiment of the present disclosure, the voltage providing module 3 may provide the voltage of the first power supply voltage terminal Vdd and the voltage of the initial voltage terminal Vinit to the driving module 5 under the control of the reset signal terminal Reset, to turn on the driving module 5. After the driving module 5 is turned on, all driving transistors included in the driving module 5 have currents passing through, magnitudes of the currents change with time and the driving transistors will not be in a certain state for a long time, hysteresis effect can be mitigated and a drift of a threshold voltage of the driving transistors can be reduced, thereby decreasing a brightness difference perceptible by human eyes caused by a low-frequency switching operation. In addition, the pixel circuit 1 of the embodiment of the present disclosure enables all the driving transistors to be at a same reference when different frames are switched in a resetting stage, which can control uniformity of light emission characteristics of the driving transistors.

Figure 5:
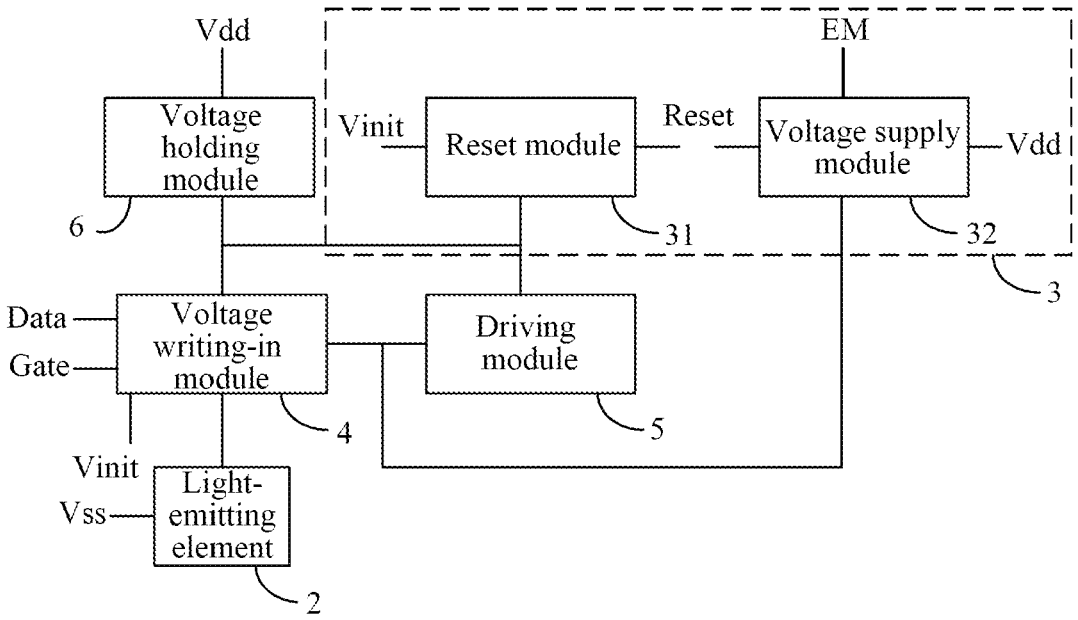
FIG. 5 is a block diagram of another structure of a pixel circuit according to an embodiment of the present disclosure.

In an exemplary implementation, as shown in FIG. 5, the voltage providing module 3 includes a reset module 31 and a voltage supply module 32. The reset module 31 is respectively connected with the reset signal terminal Reset, the initial voltage terminal Vinit, the voltage writing-in module 4 and the driving module 5, and is configured to provide the voltage of the initial voltage terminal Vinit to the driving module 5 under the control of the reset signal terminal Reset. The voltage supply module 32 is respectively connected with the reset signal terminal Reset, the light-emitting control terminal EM, the first power supply voltage terminal Vdd, the voltage writing-in module 4 and the driving module 5, and is configured to provide the voltage of the first power supply voltage terminal Vdd to the driving module 5 under the control of the reset signal terminal Reset; and provide the voltage of the first power supply voltage terminal Vdd to the driving module 5 under the control of the light-emitting control terminal EM.

In an exemplary implementation, the reset module 31 and the voltage supply module 32 are hardware circuit modules.

Therefore, in the embodiment of the present disclosure, the voltage of the initial voltage terminal Vinit is provided to the driving module 5 through the reset module 31 under the control of the reset signal terminal Reset. In addition, the voltage of the first power supply voltage terminal Vdd is provided to the driving module 5 through the voltage supply module 32, so that all driving transistors in the pixel circuit 1 can be at a same reference when different frames are switched in a resetting stage (i.e., a reset stage or an initialization stage) of the pixel circuit 1, which can control uniformity of light emission characteristics of the driving thin film transistors.

The pixel circuit of the embodiment of the present disclosure will be described in detail with reference to FIGS. 6 to 8.

Figure 6:
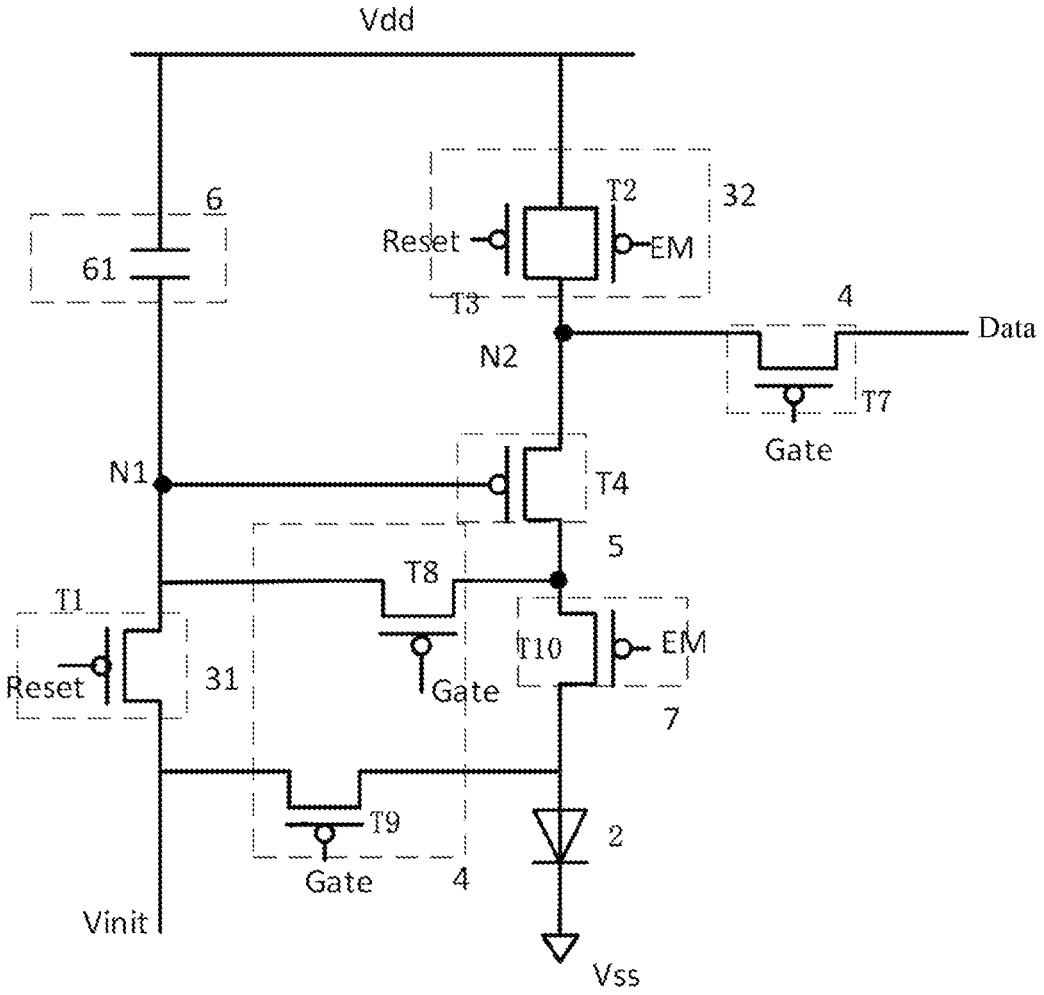
FIG. 6 is a schematic diagram of a circuit structure of a pixel circuit according to an embodiment of the present disclosure.

In an exemplary implementation, referring to FIG. 6, a reset module 31 includes a first transistor T1. A control terminal of the first transistor T1 is connected with a reset signal terminal Reset, a first terminal of the first transistor T1 is respectively connected with an initial voltage terminal Vinit and a voltage writing-in module 4, and a second terminal of the first transistor T1 is respectively connected with the voltage writing-in module 4 and a driving module 5.

In an exemplary implementation, still referring to FIG. 6, a voltage supply module 32 includes a second transistor T2 and a third transistor T3. A control terminal of the second transistor T2 is connected with the reset signal terminal Reset, a first terminal of the second transistor T2 is connected with a first power supply voltage terminal Vdd, and a second terminal of the second transistor T2 is respectively connected with the voltage writing-in module 4 and the driving module 5. A control terminal of the third transistor T3 is connected with a light-emitting control terminal EM, a first terminal of the third transistor T3 is connected with the first terminal of the second transistor T2, and a second terminal of the third transistor T3 is connected with the second terminal of the second transistor T2.

In an exemplary implementation, still referring to FIG. 6, the driving module 5 includes a fourth transistor T4. A control terminal of the fourth transistor T4 is respectively connected with the reset module 31 and the voltage writing-in module 4, a first terminal of the fourth transistor T4 is respectively connected with the voltage supply module 32 and the voltage writing-in module 4, and a second terminal of the fourth transistor T4 is connected with the voltage writing-in module 4.

In an exemplary implementation, the driving module 5 includes a fifth transistor T5 and a sixth transistor T6 (which are not shown in FIG. 6, in this embodiment, the fifth transistor T5 and the sixth transistor T6 replace the fourth transistor T4 in FIG. 6). A control terminal of the fifth transistor T5 is respectively connected with the reset module 31 and the voltage writing-in module 4, a first terminal of the fifth transistor T5 is respectively connected with the voltage supply module 32 and the voltage writing-in module 4, and a second terminal of the fifth transistor T5 is connected with the voltage writing-in module 4. A control terminal of the sixth transistor T6 is connected with a preset potential, a first terminal of the sixth transistor T6 is connected with the first terminal of the fifth transistor T5, and a second terminal of the sixth transistor T6 is connected with the second terminal of the fifth transistor T5. The preset potential here may be either a positive voltage or a negative voltage. In actual design, a corresponding potential, such as a high level potential VDD, is connected as needed. When the driving module 5 includes the fifth transistor T5 and the sixth transistor T6, influence of a gate point on charges of a gate insulating layer can be balanced, which is equivalent to adding one pinning potential, and thus hysteresis effect can be further mitigated, and a brightness difference perceptible by human eyes caused by a low-frequency switching operation can be decreased.

In an exemplary implementation, further still referring to FIG. 6, the voltage writing-in module 4 includes a seventh transistor T7, an eighth transistor T8 and a ninth transistor T9. A control terminal of the seventh transistor T7 is connected with the signal terminal Gate, a first terminal of the seventh transistor T7 is respectively connected with the voltage supply module 32 and the driving module 5, and a second terminal of the seventh transistor T7 is connected with the data input terminal Data. A control terminal of the eighth transistor T8 is connected with the signal terminal Gate, a first terminal of the eighth transistor T8 is respectively connected with the reset module 31 and the driving module 5, and a second terminal of the eighth transistor T8 is connected with the driving module 5. A control terminal of the ninth transistor T9 is connected with the signal terminal Gate, a first terminal of the ninth transistor T9 is respectively connected with the reset module 31 and the initial voltage terminal Vinit, and a second terminal of the ninth transistor T9 is connected with the light-emitting element 2.

In an exemplary implementation, further still referring to FIG. 6, the pixel circuit 1 further includes a light-emitting control module 7. The light-emitting control module 7 is respectively connected with the light-emitting control terminal EM, the voltage writing-in module 4, the driving module 5 and the light-emitting element 2, and is configured to control the light-emitting element 2 to emit light under control of the light-emitting control terminal EM. The light-emitting element 2 is connected with a second power supply voltage terminal Vss.

In an exemplary implementation, the light-emitting control module 7 is a hardware circuit module.

In an exemplary implementation, further still referring to FIG. 6, the light-emitting control module includes a tenth transistor T10. A control terminal of the tenth transistor T10 is connected with the light-emitting control terminal EM, a first terminal of the tenth transistor T10 is respectively connected with the voltage writing-in module 4 and the light-emitting element 2, and a second terminal of the tenth transistor T10 is respectively connected with the voltage writing-in module 4 and the driving module 5.

In an exemplary implementation, further still referring to FIG. 6, the pixel circuit 1 includes a voltage holding module 6. The voltage holding module 6 is respectively connected with the first power supply voltage terminal Vdd, the control terminal of the fourth transistor T4, the voltage writing-in module 4 and the reset module 31, and is configured to hold a voltage of the control terminal of the fourth transistor T4.

In an exemplary implementation, the voltage holding module 6 is a hardware circuit module.

In an exemplary implementation, further still referring to FIG. 6, the voltage holding module 6 includes a capacitor 61. One terminal of the capacitor 61 is connected with the first power supply voltage terminal Vdd, and the other terminal of the capacitor 61 is respectively connected with the control terminal of the fourth transistor T4, the voltage writing-in module 4 and the reset module 31.

In an exemplary implementation, as shown in FIG. 6, the pixel circuit 1 in the embodiment of the present disclosure includes a first transistor T1, a second transistor T2, a third transistor T3, a fourth transistor T4, a seventh transistor T7, an eighth transistor T8, a ninth transistor T9, a tenth transistor T10, a capacitor 61, and a light-emitting element 2. The first transistor T1, the second transistor T2, the third transistor T3, the fourth transistor T4, the seventh transistor T7, the eighth transistor T8, the ninth transistor T9 and the tenth transistor T10 are all P-type thin film transistors.

In an exemplary implementation, a control terminal of the first transistor T1 is connected with the reset signal terminal Reset, a first terminal of the first transistor T1 is respectively connected with the initial voltage terminal Vinit and a first terminal of the ninth transistor T9, and a second terminal of the first transistor T1 is respectively connected with a first terminal of the eighth transistor T8 and a control terminal of the fourth transistor T4.

A control terminal of the second transistor T2 is connected with the reset signal terminal Reset, a first terminal of the second transistor T2 is connected with the first power supply voltage terminal Vdd, and a second terminal of the second transistor T2 is respectively connected with a first terminal of the seventh transistor T7 and a first terminal of the fourth transistor T4.

A control terminal of the third transistor T3 is connected with the light-emitting control terminal EM, a first terminal of the third transistor T3 is connected with the first terminal of the second transistor T2, and a second terminal of the third transistor T3 is connected with the second terminal of the second transistor T2.

A control terminal of the fourth transistor T4 is respectively connected with the second terminal of the first transistor T1, a first terminal of the eighth transistor T8 and one terminal of the capacitor 61, a first terminal of the fourth transistor T4 is respectively connected with the second terminal of the second transistor T2 and the first terminal of the seventh transistor T7, and a second terminal of the fourth transistor T4 is connected with a second terminal of the eighth transistor T8 and a second terminal of the tenth transistor T10.

A control terminal of the seventh transistor T7 is connected with the signal terminal Gate, a first terminal of the seventh transistor T7 is respectively connected with the second terminal of the second transistor T2 and the first terminal of the fourth transistor T4, and a second terminal of the seventh transistor T7 is connected with the data input terminal Data.

A control terminal of the eighth transistor T8 is connected with the signal terminal Gate, a first terminal of the eighth transistor T8 is respectively connected with the second terminal of the first transistor T1 and the control terminal of the fourth transistor T4, and a second terminal of the eighth transistor T8 is connected with the second terminal of the fourth transistor T4.

A control terminal of the ninth transistor T9 is connected with the signal terminal Gate, a first terminal of the ninth transistor T9 is respectively connected with the first terminal of the first transistor T1 and the initial voltage terminal Vinit, and a second terminal of the ninth transistor T9 is connected with the light-emitting element 2 and a first terminal of the tenth transistor T10.

A control terminal of the tenth transistor T10 is connected with the light-emitting control terminal EM, a first terminal of the tenth transistor T10 is respectively connected with the second terminal of the ninth transistor T9 and the light-emitting element 2, and a second terminal of the tenth transistor T10 is respectively connected with the second terminal of the eighth transistor T8 and the second terminal of the fourth transistor T4.

In an exemplary implementation, the first terminals of the first transistor T1, the second transistor T2, the third transistor T3, the fourth transistor T4, the seventh transistor T7, the eighth transistor T8, the ninth transistor T9 and the tenth transistor T10 may be source, or may be drain. The second terminals of the first transistor T1, the second transistor T2, the third transistor T3, the fourth transistor T4, the seventh transistor T7, the eighth transistor T8, the ninth transistor T9 and the tenth transistor T10 may be drain, or may be source. Positions of the source and the drain may be interchanged in actual design.

Figure 7:
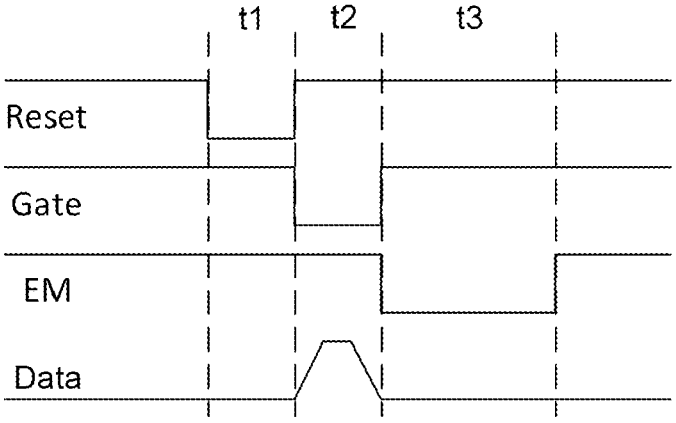
FIG. 7 is a diagram of timing of the pixel circuit of FIG. 6.

With reference to FIG. 6 and FIG. 7, a working process of the pixel circuit 1 provided by the embodiment of the present disclosure will be described in detail below. When working, the working process of the pixel circuit 1 includes three working stages, namely, a resetting stage t1, a compensating stage t2, and a light-emitting stage t3.

In the resetting stage t1, as shown in FIG. 7, the reset signal terminal Reset outputs a low level signal, the signal terminal Gate and the light-emitting control terminal EM output a high level signal, the first transistor t1 and the third transistor T3 are turned on, and the second transistor T2, the seventh transistor T7, the eighth transistor T8, the ninth transistor T9 and the tenth transistor T10 are turned off. At this time, an initialization potential Vinit output by the initial voltage terminal Vinit is written into a first node N1 through the first transistor T1, wherein a potential of the first node N1 is equal to the initialization potential Vinit. In addition, a high level voltage VDD output by the first power supply voltage terminal Vdd is written into a second node N2 through the third transistor T3. At this time, for the fourth transistor T4, a gate-source voltage Vgs=Vinit-VDD, and the fourth transistor T4 is turned on and biased. Generally, a voltage of Vinit is −3V, a voltage of VDD is 4.5V, a threshold voltage of the fourth transistor T4 is about −2V, and since the fourth transistor T4 is turned on and biased, all driving transistors have currents passing through without being at the same gate-source voltage Vgs for a long time, which can mitigate hysteresis effect of the driving transistors.

Compared with the pixel circuit described above, the pixel circuit provided by the embodiment of the present disclosure can determine a state and a hysteresis condition of the driving transistors during the resetting stage t1, and a fixed bias voltage is provided to the fourth transistor T4, so that all the driving transistors are at the same reference when different frames are switched, which can control uniformity of light emission characteristics of the driving transistors.

Figure 8:
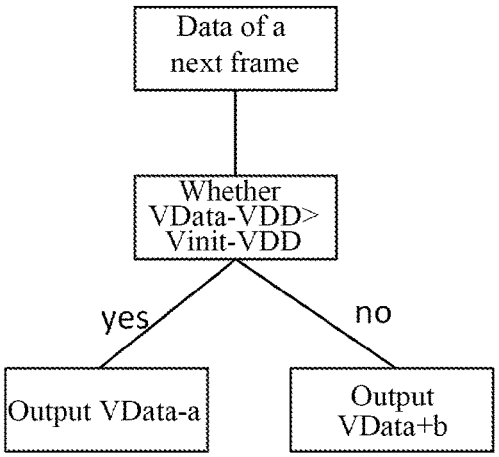
FIG. 8 is a flowchart of adjusting a data voltage by an algorithm when an image A is switched to an image B according to an embodiment of the present disclosure.

In addition, as shown in FIG. 8, when an image A is switched to an image B in the embodiment of the present disclosure, a negative bias phenomenon of a first frame of data of the image B can be predicted, correspondingly the data can be enlarged or shrunk through an algorithm to adjust brightness. For example, in a low frequency state, the first frame in the image B may be calculated by the algorithm to determine whether a difference between a data voltage VData of the first frame in the B image and the VDD is greater than a difference between the Vinit and the VDD, if so, the data voltage of the first frame in the image B is adjusted to output VData−a, otherwise, VData+b is output, so as to make up for a drift caused by a threshold voltage in advance, preventing too large brightness difference from brightness of a subsequent holding frame. Here, a and b may be obtained by using an algorithm to look up a table, and a process of the algorithm will not be repeated here.

In the compensating stage t2, as shown in FIG. 7, the signal terminal Gate outputs a low level signal, the reset signal terminal Reset and the light-emitting control terminal EM output a high level signal, the seventh transistor T7, the eighth transistor T8 and the ninth transistor T9 are turned on, and the first transistor T1, the second transistor T2, the third transistor T3 and the tenth transistor T10 are turned off. At this time, the initialization potential Vinit output by the initial voltage terminal Vinit is written into an anode of the light-emitting element 2 through the ninth transistor T9, which can prevent the light-emitting element 2 from emitting light during data writing. In addition, a data voltage VData output by the data input terminal Data is written into the second node N2 through the seventh transistor T7. At this time, the fourth transistor T4 and the eighth transistor T8 are turned on, and the data voltage VData charges the N1 point. When the Vgs of the fourth transistor T4 is equal to the VTH, the data voltage VData no longer charges the N1, the fourth transistor T4 is turn off, and finally, the potential of the N1 becomes VN1=VData+VTH, wherein the potential of N1 is a gate potential of the fourth transistor T4 in the light-emitting stage.

In the light-emitting phase t3, as shown in FIG. 7, the light-emitting control terminal EM outputs a low level signal, the signal terminal Gate and the reset signal terminal Reset output a high level signal, the second transistor T2 and the tenth transistor T10 are turned on, and the first transistor T1, the third transistor T3, the seventh transistor T7, the eighth transistor T8 and the ninth transistor T9 are turned off. At this time, the fourth transistor T4 drives the light-emitting element 2 to emit light to meet an actual display requirement.

In an exemplary implementation, a current formula of the light-emitting element 2 may be:

$$\text{Ioled}=K(Vgs-VTH)^2=K(\text{VData}+VTH-VDD-VTH)^2$$

It can be seen that a current of the light-emitting element 2 is actually uncorrelated with a threshold voltage VTH of the fourth transistor T4, which eliminates influence of the threshold voltage.

Figure 9:
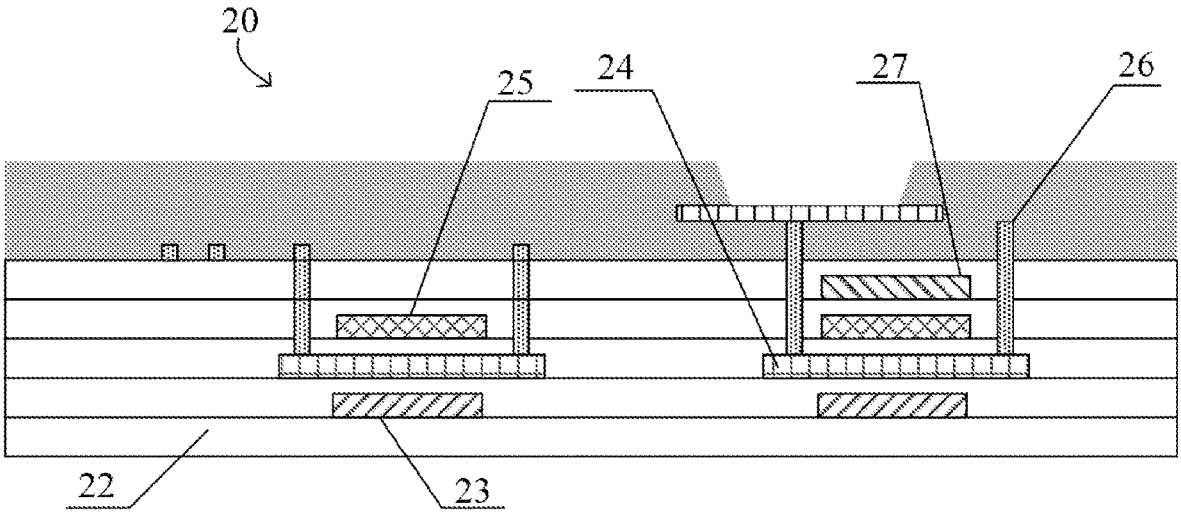
FIG. 9 is a schematic diagram of a structure of a part of film layers of a display substrate according to an embodiment of the present disclosure.

FIG. 9 shows a display substrate 20 according to an embodiment of the present disclosure. As shown in FIG. 9, the display substrate 20 includes multiple pixel units disposed in an array. In an exemplary implementation, each pixel unit may include the above pixel circuit 1. Since the display substrate includes the above pixel circuit 1, the display substrate has a same beneficial effect as the above pixel circuit 1. Therefore, the beneficial effect of the display substrate in this exemplary implementation will not be repeated here.

In an exemplary implementation, as shown in FIG. 9, the display substrate 20 includes a substrate 22, a light shielding layer 23, an active layer 24, a first gate layer 25, a source-drain layer 26 and a second gate layer 27, wherein the light shielding layer 23, the active layer 24, the first gate layer 25, the source-drain layer 26 and the second gate layer 27 are sequentially stacked on one side of the substrate 22. A film layer disposing mode of the display substrate 20 may use any known disposing mode, which will not be repeated here.

When the voltage supply module 32 includes the second transistor T2 and the third transistor T3 (corresponding to thin film transistors on a left side in FIG. 9), a gate of the second transistor T2 is disposed in a same layer as the light shielding layer 23, a gate of the third transistor T3 is disposed in a same layer as the first gate layer 25, and the second transistor T2 and the third transistor T3 share a source and a drain. The first gate layer 25 of the thin film transistor on the left side in FIG. 9 is connected with the light-emitting control terminal EM, and the light shielding layer 23 is connected with the reset signal terminal Reset. Since the gate of the second transistor T2 is disposed on the same layer as the light shielding layer 23, in the embodiment of the present disclosure no additional process needs to be added to manufacture the gate of the second transistor T2, which can save production cost; and since the second transistor T2 and the third transistor T3 share the source and the drain, the production cost can be further reduced.

When the driving module 5 includes the fifth transistor T5 and the sixth transistor T6 (corresponding to thin film transistors on a right side in FIG. 9), a gate of the fifth transistor T5 is disposed in a same layer as the light shielding layer 23, a gate of the sixth transistor T6 is disposed in a same layer as the first gate layer 25, and the fifth transistor T5 and the sixth transistor T6 share a source and a drain. The light shielding layer 23 of the thin film transistors on the right side in FIG. 9 is connected with a preset potential, and the second gate layer 27 is located above the first gate layer 25, wherein the second gate layer 27 may be served as one electrode plate of a capacitor. Similarly, since the gate of the fifth transistor T5 is disposed in the same layer as the light shielding layer 23, in the embodiment of the present disclosure no additional process needs to be added to manufacture the gate of the fifth transistor T5, which can save production cost; and since the fifth transistor T5 and the sixth transistor T6 share the source and the drain, the production cost can be further reduced.

An embodiment of the present disclosure discloses a display apparatus, which includes the above display substrate 20. Since the display apparatus includes the above display substrate 20, the display apparatus has a same beneficial effect as the above display substrate 20. Therefore, the beneficial effect of the display apparatus will not be repeated here.

Figure 10:
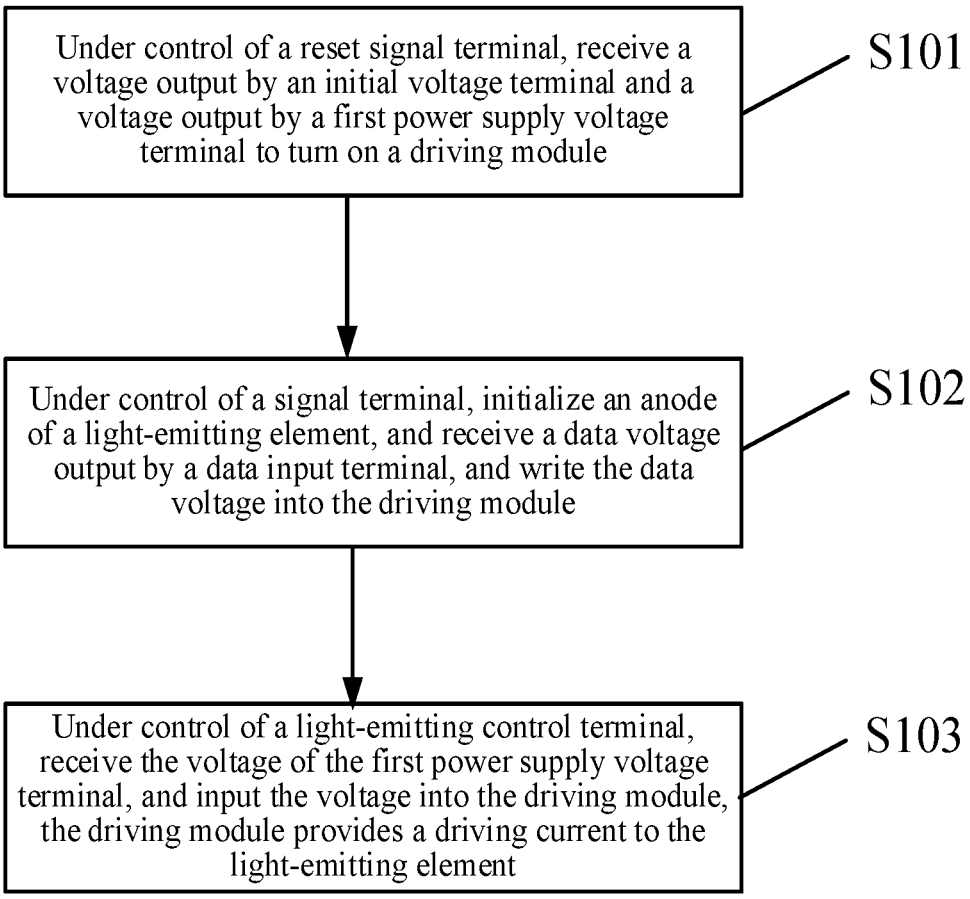
FIG. 10 is a flowchart of a driving method of a pixel circuit according to an embodiment of the present disclosure.
Figure 11:
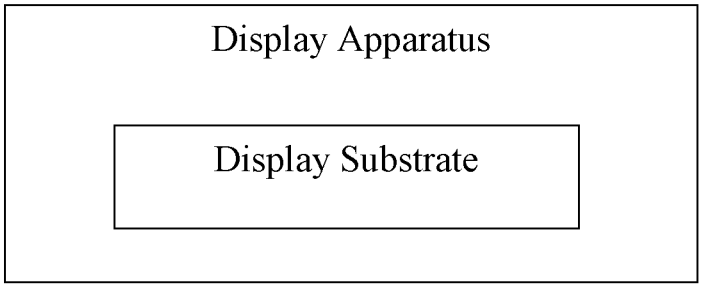
FIG. 11 is a schematic diagram of a structure of a display apparatus including a display substrate according to an embodiment of the present disclosure.
Figure 12:
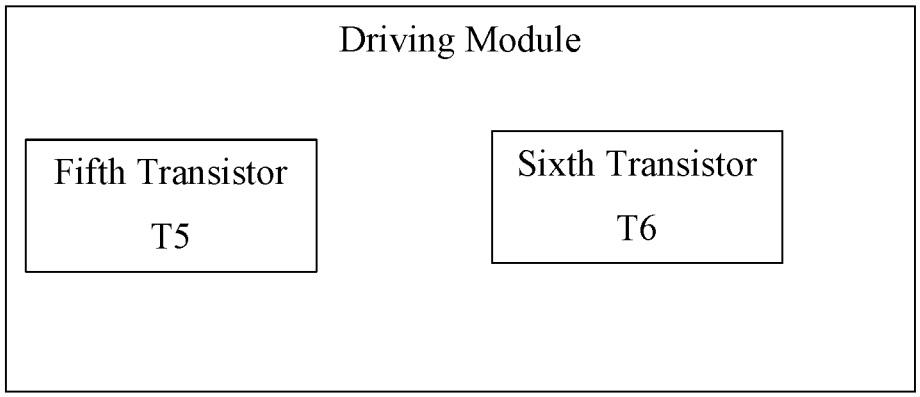
FIG. 12 is a schematic diagram of a structure of a driving module including a fifth transistor and sixth transistor according to an embodiment of the present disclosure.
Figure 13:
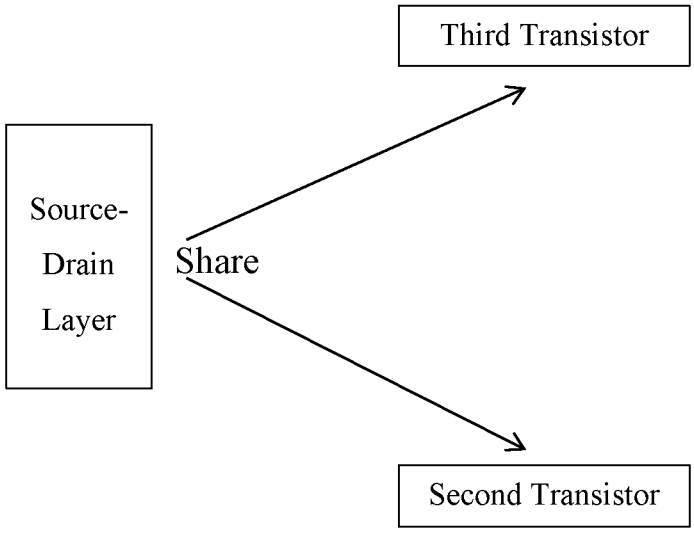
FIG. 13 is a schematic diagram of a second transistor and a third transistor sharing a source-drain layer according to an embodiment of the present disclosure.

FIG. 10 shows a driving method of the pixel circuit 1 according to an embodiment of the present disclosure. As shown in FIG. 10, the method includes acts S101 to S103.

In S101, under control of a reset signal terminal Reset, a voltage output by an initial voltage terminal Vinit and a voltage output by a first power supply voltage terminal Vdd are received to turn on a driving module 5.

In S102, under control of a signal terminal Gate, an anode of a light-emitting element 2 is initialized, and a data voltage output by a data input terminal Data is received, and the data voltage is written into the driving module 5.

In S103, under control of a light-emitting control terminal EM, the voltage of the first power supply voltage terminal Vdd is received and input to the driving module 5, and the driving module 5 provides a driving current to the light-emitting element 2.

In the driving method, under the control of the reset signal terminal Reset, the voltages output by the initial voltage terminal Vinit and the first power supply voltage terminal Vdd are received, so that the driving module 5 is turned on. In addition, under the control of the signal terminal Gate, the data voltage output by the data input terminal Data is received and is written into the driving module 5. According to the driving method, all thin film transistors in the pixel circuit 1 can be at a same reference when different frames are switched in a resetting stage of the pixel circuit 1, which may control uniformity of light emission characteristics of the driving thin film transistors. In addition, a drift caused by a threshold voltage can be compensated in advance by a preset algorithm, which decreases a brightness difference from brightness of a subsequent holding frame.

In S103, the light-emitting control terminal EM outputs a low level signal, and at this time, the second transistor T2 and the tenth transistor T10 are turned on, and a driving current is provided to the light-emitting element 2 through the driving module 5, so that the light-emitting element 2 emits light. In addition, the working principle of the pixel circuit 1 has been introduced above, which will not be repeated here.

Beneficial effects of the embodiments of the present disclosure at least include the following.

1. In the embodiment of the present disclosure, the voltage providing module 3 may provide the voltage of the first power supply voltage terminal Vdd and the voltage of the initial voltage terminal Vinit to the driving module 5 under the control of the reset signal terminal Reset, to turn on the driving module 5. After the driving module 5 is turned on, all driving transistors included in the driving module 5 have currents passing through, magnitudes of the currents change with time and the driving transistors will not be in a certain state for a long time, hysteresis effect can be mitigated and a drift of a threshold voltage of the driving transistors can be reduced, thereby decreasing a brightness difference perceptible by human eyes caused by a low-frequency switching operation. In addition, the pixel circuit 1 of the embodiment of the present disclosure enables all the driving transistors to be at a same reference when different frames are switched in a resetting stage, which can control uniformity of light emission characteristics of the driving transistors.

2. In the embodiment of the present disclosure, when the driving module 5 includes the fifth transistor T5 and the sixth transistor T6, influence of a gate point on charges of a gate insulating layer can be balanced, which is equivalent to adding one pinning potential, and thus hysteresis effect can be further mitigated, a brightness difference perceptible by human eyes caused by a low-frequency switching operation can be decreased.

Those skilled in the art will understand that acts, measures and solutions in various operations, methods, and the process already discussed in the present disclosure may be alternated, changed, combined or deleted. Further, other acts, measures and solutions in various operations, methods and processes already discussed in the present disclosure may also be alternated, changed, rearranged, divided, combined or deleted. Further, acts, measures and solutions in current arts having the same functions with those in various operations, methods and processes disclosed in the present disclosure may also be alternated, changed, rearranged, divided, combined or deleted.

In the description of the present disclosure, it needs to be understood that, an orientation or position relationship indicated by terms "center", "upper", "lower", "front", "rear", "left", "right", "vertical", "horizontal", "top", "bottom", "inside", "outside", or the like is based on the orientation or position relationship shown in the drawings, and this is only for ease of description of the present disclosure and simplification of the description, rather than indicating or implying that the referred apparatus or element must have a specific orientation, or be constructed and operated in a particular orientation, and therefore this cannot be understood as a limitation on the present disclosure.

The terms "first" and "second" are used for description purposes only, and cannot be interpreted as indicating or implying relative importance or implicitly indicating the quantity of technical features referred to. Thus, features defined by "first" and "second" may include one or more of the features explicitly or implicitly. In the description of the present disclosure, unless otherwise specified, "multiple" means two or more.

The above is only part of the implementations of the present disclosure, and it should be noted that for those of ordinary skill in the art, without departing from the principles of the present disclosure, several improvements and modifications can be made, and these improvements and modifications should also be regarded as covered by the protection scope of the present disclosure.

What is claimed is:

1. A display substrate, comprising a substrate, a light shielding layer, an active layer, a first gate layer, a source-drain layer and a second gate layer, wherein the display substrate further comprises a plurality of pixel units disposed in an array, wherein each of the plurality of pixel units comprises a pixel circuit, and the pixel circuit comprises a light-emitting element, a voltage providing module, a voltage writing-in module and a driving module; wherein the voltage providing module is respectively connected with a first power supply voltage terminal, an initial voltage terminal, a reset signal terminal, a light-emitting control terminal, the voltage writing-in module and the driving module, and the voltage providing module is configured to provide a voltage of the first power supply voltage terminal and a voltage of the initial voltage terminal to the driving module under control of the reset signal terminal to turn on the driving module; and provide the voltage of the first power supply voltage terminal to the driving module under control of the light-emitting control terminal;

the voltage writing-in module is respectively connected with a signal terminal, a data input terminal, the initial voltage terminal, the voltage providing module, the driving module and the light-emitting element, and the voltage writing-in module is configured to write a data voltage into the driving module under control of the signal terminal;

the driving module is respectively connected with the voltage providing module and the voltage writing-in module, the driving module is separate from the voltage writing-in module, and the driving module is configured to provide a driving current to the light-emitting element, and the first gate layer is connected with the light-emitting element, and the second gate layer is located above the first gate layer;

wherein the voltage providing module comprises a voltage supply module, the voltage supply module comprises a second transistor and a third transistor, and the second transistor and the third transistor share a source-drain layer.

2. The display substrate of claim 1, wherein the voltage providing module comprises a reset module;

the reset module is respectively connected with the reset signal terminal, the initial voltage terminal, the voltage writing-in module and the driving module, and the reset module is configured to provide the voltage of the initial voltage terminal to the driving module under the control of the reset signal terminal; and the voltage supply module is respectively connected with the reset signal terminal, the light-emitting control terminal, the first power supply voltage terminal, the voltage writing-in module and the driving module, and the voltage supply module is configured to provide the voltage of the first power supply voltage terminal to the driving module under the control of the reset signal terminal; and provide the voltage of the first power supply voltage terminal to the driving module under the control of the light-emitting control terminal.

3. The display substrate of claim 2, wherein the reset module comprises a first transistor;

a control terminal of the first transistor is connected with the reset signal terminal, a first terminal of the first transistor is respectively connected with the initial voltage terminal and the voltage writing-in module, and a second terminal of the first transistor is respectively connected with the voltage writing-in module and the driving module.

4. The display substrate of claim 2, wherein a control terminal of the second transistor is connected with the reset signal terminal, a first terminal of the second transistor is connected with the first power supply voltage terminal, and a second terminal of the second transistor is respectively connected with the voltage writing-in module and the driving module; and a control terminal of the third transistor is connected with the light-emitting control terminal, a first terminal of the third transistor is connected with the first terminal of the second transistor, and a second terminal of the third transistor is connected with the second terminal of the second transistor.

5. The display substrate of claim 2, wherein the driving module comprises a fourth transistor;

a control terminal of the fourth transistor is respectively connected with the reset module and the voltage writing-in module, a first terminal of the fourth transistor is respectively connected with the voltage supply module and the voltage writing-in module, and a second terminal of the fourth transistor is connected with the voltage writing-in module.

6. The display substrate of claim 5, wherein the pixel circuit comprises a voltage holding module;

the voltage holding module is respectively connected with the first power supply voltage terminal, the control terminal of the fourth transistor, the voltage writing-in module and the reset module, and the voltage holding module is configured to hold a voltage of the control terminal of the fourth transistor.

7. The display substrate of claim 6, wherein the voltage holding module comprises a capacitor;

one terminal of the capacitor is connected with the first power supply voltage terminal, and another terminal of the capacitor is respectively connected with the control terminal of the fourth transistor, the voltage writing-in module and the reset module.

8. The display substrate of claim 2, wherein the driving module comprises a fifth transistor and a sixth transistor;

a control terminal of the fifth transistor is respectively connected with the reset module and the voltage writing-in module, a first terminal of the fifth transistor is respectively connected with the voltage supply module and the voltage writing-in module, and a second terminal of the fifth transistor is connected with the voltage writing-in module; and a control terminal of the sixth transistor is connected with a preset potential, a first terminal of the sixth transistor is connected with the first terminal of the fifth transistor, and a second terminal of the sixth transistor is connected with the second terminal of the fifth transistor.

9. The display substrate of claim 2, wherein the voltage writing-in module comprises a seventh transistor, an eighth transistor and a ninth transistor;

a control terminal of the seventh transistor is connected with the signal terminal, a first terminal of the seventh transistor is respectively connected with the voltage supply module and the driving module, and a second terminal of the seventh transistor is connected with the data input terminal;

a control terminal of the eighth transistor is connected with the signal terminal, a first terminal of the eighth transistor is respectively connected with the reset module and the driving module, and a second terminal of the eighth transistor is connected with the driving module; and a control terminal of the ninth transistor is connected with the signal terminal, a first terminal of the ninth transistor is respectively connected with the reset module and the initial voltage terminal, and a second terminal of the ninth transistor is connected with the light-emitting element.

10. The display substrate of claim 1, wherein the pixel circuit comprises a light-emitting control module;

the light-emitting control module is respectively connected with the light-emitting control terminal, the voltage writing-in module, the driving module and the light-emitting element, and the light-emitting control module is configured to control the light-emitting element to emit light under the control of the light-emitting control terminal; and the light-emitting element is connected with a second power supply voltage terminal.

11. The display substrate of claim 10, wherein the light-emitting control module comprises a tenth transistor;

a control terminal of the tenth transistor is connected with the light-emitting control terminal, a first terminal of the tenth transistor is respectively connected with the voltage writing-in module and the light-emitting element, and a second terminal of the tenth transistor is respectively connected with the voltage writing-in module and the driving module.

12. A display apparatus, comprising a display substrate according to claim 1.

13. A driving method of a display substrate according to claim 1, comprising:

under control of the reset signal terminal, receiving the voltage of the initial voltage terminal and the voltage of the first power supply voltage terminal to turn on a driving module;

under control of the signal terminal, initializing an anode of the light-emitting element, and receiving a data voltage of the data input terminal, and writing the data voltage of the data input terminal into the driving module; and under control of the light-emitting control terminal, receiving the voltage of the first power supply voltage terminal and inputting the voltage of the first power supply voltage terminal to the driving module, providing, by the driving module, the driving current to the light-emitting element.

* * * * *